United States Patent [19]

Ritter et al.

[11] Patent Number: 4,913,650

[45] Date of Patent: Apr. 3, 1990

[54] APPARATUS FOR THE HEAT TREATMENT OF A CONTINUOUSLY ADVANCED METAL WIRE

[75] Inventors: Gerhard Ritter; Klaus Ritter, both of Graz, Austria

[73] Assignee: EVG Entwicklungs- u

[21] Appl. No.: 99,066

[22] Filed: Sep. 21, 1987

[30] Foreign Application Priority Data

Sep. 26, 1986 [AT] Austria ..... 2578/86

[51] Int. Cl.[4] ..... F27B 9/28

[52] U.S. Cl. ..... 432/59; 432/8; 34/118

[58] Field of Search ..... 432/8, 59; 34/118

[56] References Cited

U.S. PATENT DOCUMENTS

| | | | |
|---|---|---|---|
| 2,587,742 | 3/1952 | Lorig | 432/59 |
| 2,589,411 | 3/1952 | Lorig | 432/59 |
| 2,622,860 | 12/1952 | Lorig | 432/59 |
| 2,628,790 | 2/1953 | Schmidt et al. | 432/59 |
| 2,654,139 | 10/1953 | Lorig | 432/59 |
| 2,952,451 | 9/1960 | Gibbs | 432/59 |
| 3,857,673 | 12/1974 | Andrus | 432/59 |
| 3,921,317 | 11/1975 | Kolb | 34/118 |
| 3,943,735 | 3/1976 | Riedel | 34/118 |

FOREIGN PATENT DOCUMENTS

| | | | |
|---|---|---|---|
| 508135 | 9/1930 | Fed. Rep. of Germany | 34/118 |
| 595364 | 12/1932 | Fed. Rep. of Germany . | |

*Primary Examiner*—Henry C. Yuen

[57] ABSTRACT

An apparatus for the heat treatment of a continuously moved wire which loops in several turns round a drum arranged in a heat-treatment zone, has at least one tension roller which is assigned to the drum and around which each wire turn is looped in series with the drum, and the axle of which is displaceable in parallel and/or pivotable relative to the axle of the drum counter to the effect of a limited tension force exerted by a tensioning device, thereby preventing the wire from breaking in the event of an interruption in operation and the stopping of the drum.

15 Claims, 4 Drawing Sheets

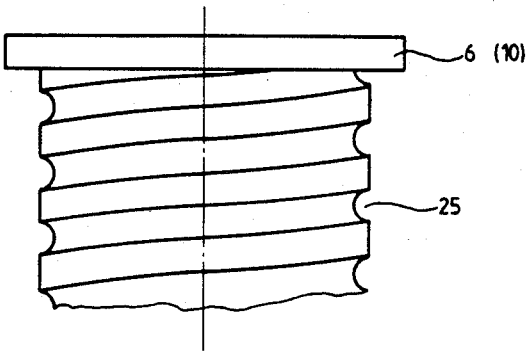
Fig. 8
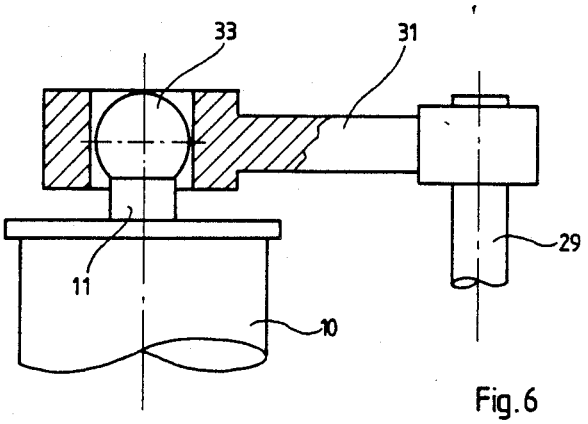
Fig. 6
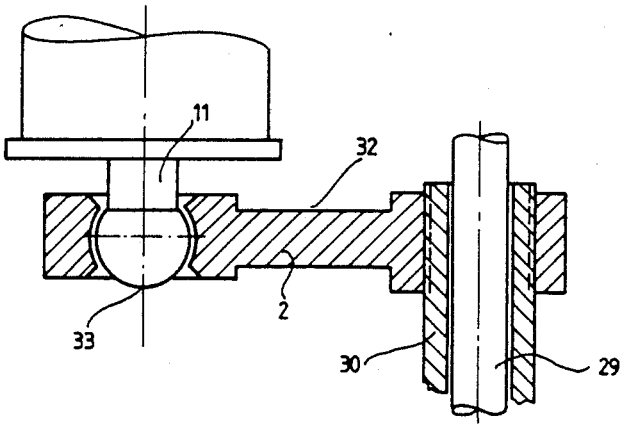

APPARATUS FOR THE HEAT TREATMENT OF A CONTINUOUSLY ADVANCED METAL WIRE

The invention relates to an apparatus for the heat treatment, especially annealing, of a continuously advanced metal wire, in which a driven drum, round which several turns of the wire are looped, is used in the heat-treatment zone.

Apparatus of this type, whilst having a space-saving design, makes it possible for the wire to remain in the heat-treatment zone for a relatively long dwell time. In an apparatus of this type known from German Patent Specification No. 595,364 and designed as an annealing furnace, the drum is shaped conically, in such a way that the drum diameter gradually decreases from the feed point of the wire to its run-off point. This is intended to ensure that the turns surround the drum with play at the run-off end, so that here there is always a relatively large free wire length available for processing in an intermittent upsetting press for the production of screw bolts and similar articles.

When the wire is drawn off continuously from the run-off end of the drum, such play between wire and drum is undesirable, and instead, the wire should rest as uniformly as possible against the drum periphery in order to prevent random shifting of the turns and to ensure distributed static friction for the wire feed. Since, where annealing treatment is concerned, the wire lengthens as a result of thermal expansion from the feed end towards the run-off end of the drum and, in cooling treatment, the opposite conditions prevail as a result of the shrinkage of the wire, if a conical drum were used the drum diameter would most probably increase gradually in the first case and decrease gradually in the second case from the feed point of the wire to its run-off point, specifically to an extent corresponding to the change in length of the wire.

However, if the wire rests against the periphery of the drum over the entire length of the latter, a problem arises when there are interruptions in operation, regardless of their cause. One cause of an interruption in operation can be that the wire becomes fouled when being drawn off from a reel. When there is an interruption in wire-annealing, the portion of wire remaining in the heat-treatment zone may be heated for so long that it is virtually burnt out and therefore becomes useless, the danger also being that because of the resistance of the rigid drum, when the wire contracts again during possible cooling it will be subjected to such high tensile stresses that it breaks. This danger of breaking is also present when there is an interruption in cooling treatment of the wire looped round a rigid drum.

The object of the invention is, therefore, initially, in a heat-treatment apparatus of the type mentioned in the introduction, to eliminate the danger that the wire will break in the event of either a deliberate interruption in operation or one caused by a fault.

According to the invention there is provided apparatus for the heat treatment of a continuously advanced metal wire, said apparatus comprising:

a driven drum, around which a plurality of turns of said wire are looped, said drum having an axis;

at least one tension roller around which a plurality of turns of said wire are looped, said at least one roller having an axis;

means for varying the position of said axis of said at least one roller relative to said axis of said drum from a predetermined position of rest; and means for changing the position of said axis of said at least one tension roller thereby to tension the turns of the wire which loop in series around said drum and said at least one tension roller with a limited tension force.

In this way, the drum and the tension roller or or a group of tension rollers form a system, around which the wire turns are looped and the circumference of which can be varied by changing the axle position of the tension roller or of each tension roller relative to the axis position of the drum, so that, when a specific tension in the wire is exceeded, it is possible to relieve the wire by changing the relative axis positions and consequently prevent it from breaking.

In the simplest case, the axis of the tension roller or of each tension roller of a group of tension rollers can be guided so as to be displaceable parallel to the axis of the drum. It is especially advantageous, however, to mount the axis of the tension roller or of each tension roller of a group of tension rollers pivotably at one end, specifically near its wire feed end for annealing the wire and near its wire run-off end for cooling the wire. As explained in more detail later, by reference to exemplary embodiments, this ensures that the circumference of the system formed by the drum and the tension roller or group of tension rollers can be varied automatically, along the system axis, according to the expansion or contraction of the wire during annealing or cooling, thus simulating in operative terms a conical drum of variable conicity and thereby ensuring that the wire turns rest closely against the drum and against the or each tension roller, without the danger that the wire will break in the event of an interruption in operation. As explained in more detail later, the displaceability of the axis of the or each tension roller can also be combined with a pivotability of the same in relation to the drum axis.

The drum and the tension roller or the group of tension rollers can be accommodated in a furnace housing filled, if appropriate, with inert gas. At the same time, the furnace housing should have a hood which opens automatically in the event of an interruption in the operation of the apparatus and in which the heating means of the furnace is preferably arranged, thus ensuring that if there is an interruption in operation, not only is the wire prevented from breaking, but also the portion of wire remaining in the furnace is prevented from burning out because of the possibility of cooling it.

Further features and advantages of the invention emerge from the following description of exemplary embodiments, with reference to the drawings. In these:

FIG. 6 shows a tension roller both displaceable in parallel and pivotable for an apparatus according to the invention;

Figure 1:
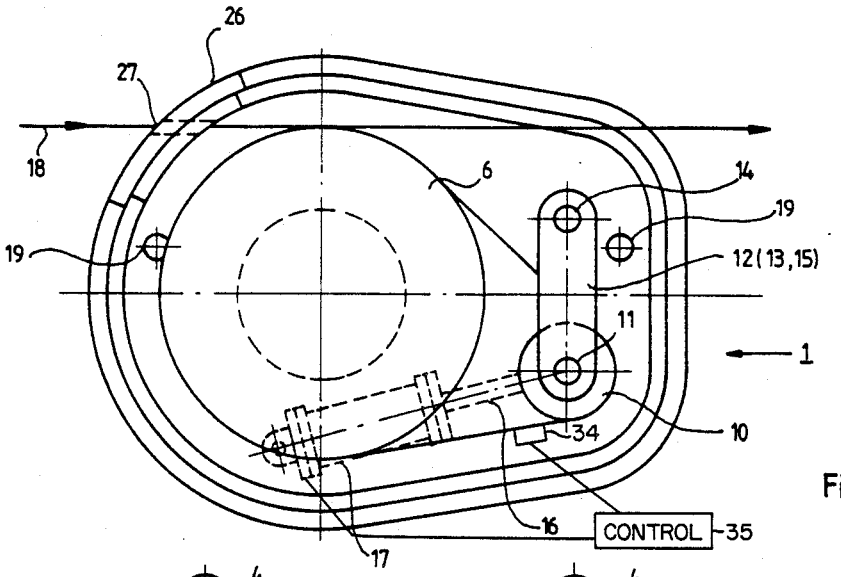
FIG. 1 shows a plan view of an apparatus according to the invention, serving as an annealing furnace, with the furnace hood lifted off.
Figure 2:
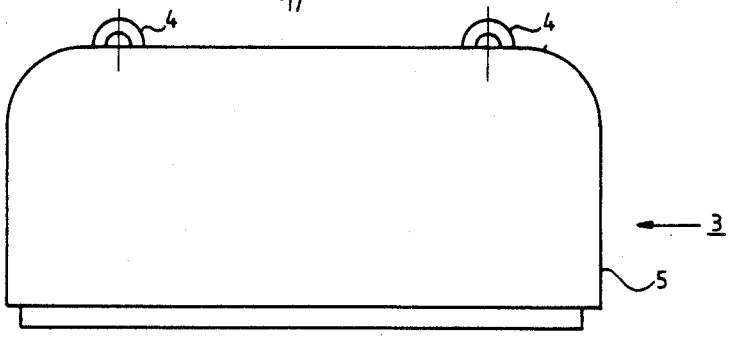
FIG. 2 shows a view of the lifted-off hood.
Figure 3:
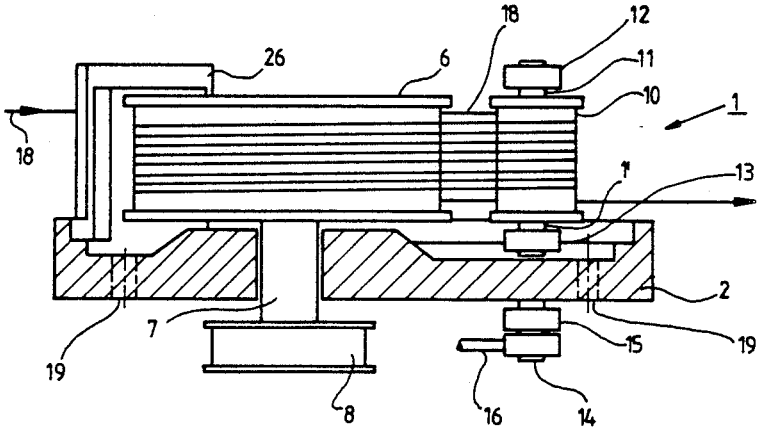
FIG. 3 shows a side view of FIG. 1 in partial section.

The annealing furnace 1, shown in FIGS. 1 to 3, has a housing consisting of a baseplate 2 and a hood 3 which can be placed on the latter by means of handles 4, and on the vertical side walls 5 of which the heating means of the furnace are advantageously mounted.

Arranged inside the annealing furnace 1 is a drum 6 which is connected for rotation with a shaft 7 passing through the baseplate 2. The shaft 7, at its end projecting from the annealing furnace 1, carries a drive member, for example a belt pulley 8.

At a distance from the drum 6 there is a tension roller 10 which is mounted rotatably, by means of axle stubs 11, on the free ends of two one-armed levers 12, 13. The other ends of the one-armed levers 12, 13 are fastened to a shaft 14 which also passes through the baseplate 2 of the annealing furnace and which, at its outer end, carries a one-armed lever 15, on the free end of which engages the piston rod 16 of a cylinder/piston arrangement 17. When the piston of the arrangement 17 is subjected to compressed air of a predetermined pressure, the wire 18 looping in several turns round the drum 6 and the tension roller 10 can consequently be subjected to any tensile force which is selected so that the thermal stability of the wire 18 is not exceeded and it is possible for the wire to contract, without breaking, in the event of sudden cooling.

If the apparatus were switched off or shut down as a result of a malfunction, there would also be the danger that the portion of wire located in the annealing furnace would be burnt out and become useless. To prevent this too, in the event of an interruption in operation, the furnace hood 3, preferably together with the heating means for the furnace, is automatically lifted off, so that there is the possibility of rapid cooling of the wire turns, thus eliminating the danger of breaking associated with it.

In order, if appropriate, to be able to fill the space under the furnace hood 3 with inert gas in a way known per se, suitable bores 19 can be made in the baseplate 2. The entire annealing furnace 1 can then be surrounded by a larger hood filled with inert gas, so that, after the furnace hood 3 has been lifted off, the cooling process takes place in a desired inert gas atmosphere.

So that the lifting off of the hood 3 is not impeded by the incoming wire 18, according to FIG. 3 there is, on the baseplate 2, a wall part 26, in which a feed guide 27 for the wire is located, and in the hood 3 there is a corresponding recess, into which the wall part 26 can engage. The running-off part of the wire is located just above the top edge of the baseplate 2 and can therefore be guided through a simple U-shaped slit in the hood.

Figure 4:
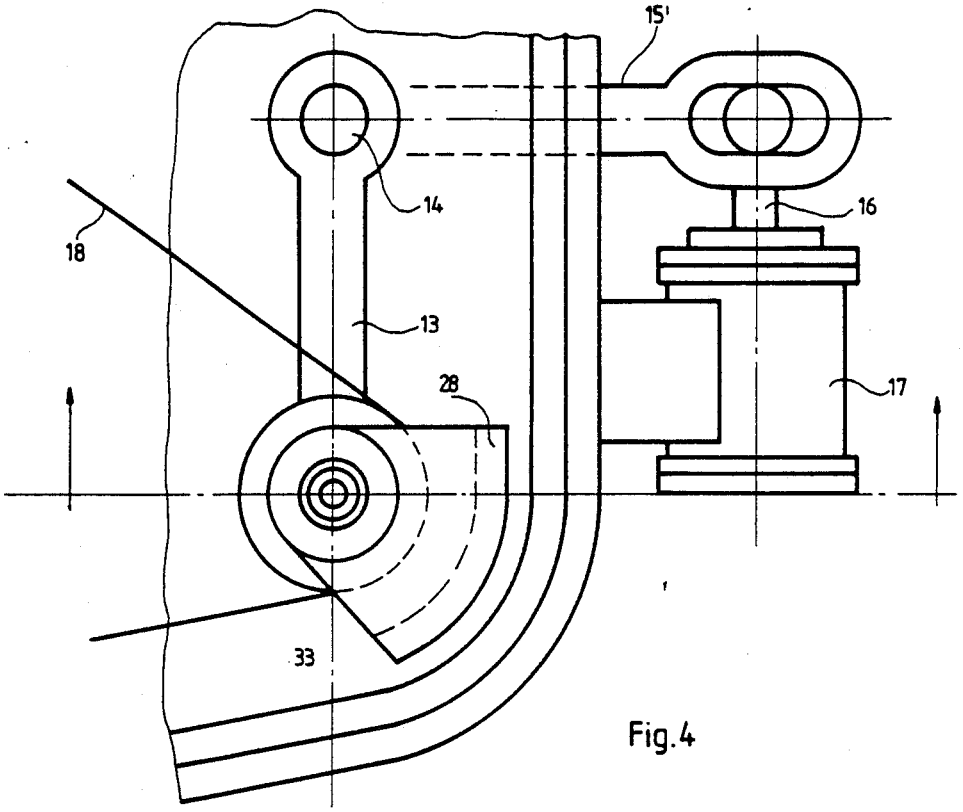
FIGS. 4 and 5 show respectively a partial plan view and side view, corresponding to FIGS. 1 and 3, of a preferred embodiment of the invention with a pivotable tension roller.
Figure 5:
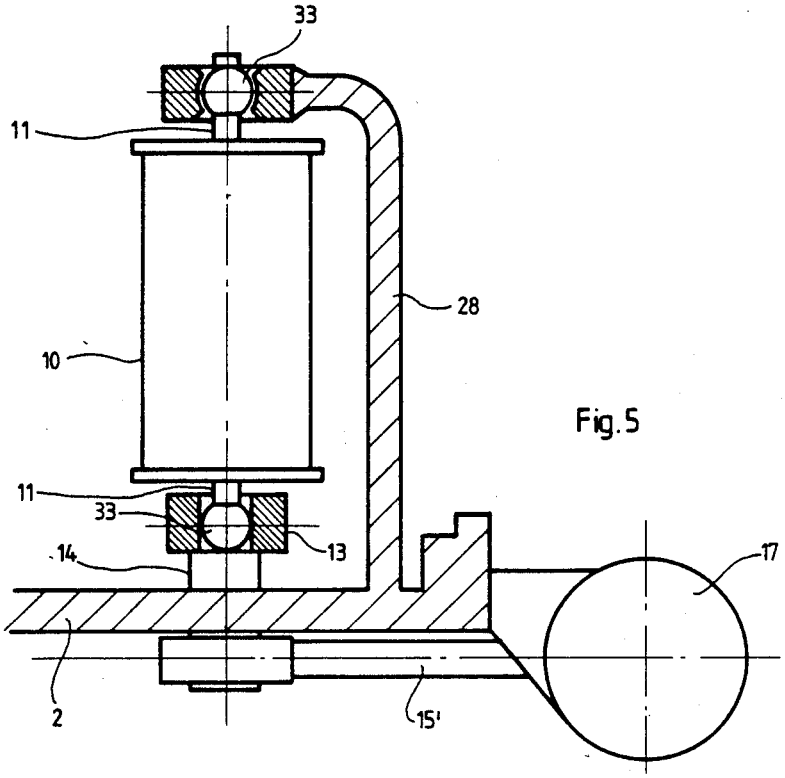

FIGS. 4 and 5 show, in plan view and side view respectively, a preferred method of mounting the tension roller 10. The axle stubs 11 of the tension roller are mounted pivotably by means of ball joints 33, specifically one roller end (the wire feed end in annealing and the wire run-off end in cooling) being in a fixed bearing block carried by a bracket 28 connected firmly to the baseplate 2, and the other end being in an adjustable bearing block located at one end of a one-armed lever 13, the other end of which is connected fixedly in terms of rotation to a shaft 14 passing through the baseplate 2. A one-armed lever 15' engages on the end of the shaft 14 projecting from the furnace housing and, at its free end, has an oblong hole, into which engages a driver connected to the piston rod 16 of a piston/cylinder arrangement 17.

Where an annealing furnace is concerned, at the start of operation, that is to say when the wire 18 looping round the drum 6 and the tension roller 10 is in a cold state, the axes of the drum and the tension roller are parallel to one another. With increasing heating of the wire, the latter expands, so that there is a continuous lengthening of the wire turns from the feed end to the run-off end of the drum. The piston/cylinder arrangement 17 then forces the axle of the tension roller 10 to assume such an inclination that the circumferential length of the drum/tension roller system increases in the axial direction from the feed point of the wire to the run-off point of the latter, and the wire 18 rests essentially uniformly against the drum and against the tension roller.

FIG. 6 illustrates a construction of the tension roller 10, in which the latter can both shift and pivot. Here, two coaxial shafts 29, 30 are provided instead of the shaft 14. A one-armed lever 31 is connected fixedly in terms of rotation to one end of the inner shaft 29 and a one-armed lever 32 is so connected to one end of the outer shaft 30. Each of the one-armed levers 31, 32 carries, at its free end, a bearing block, into which one of the axle stubs 11 of the tension roller 10 engages by means of a ball joint 33. The coaxial shafts 29, 30, at their lower ends projecting from the annealing furnace, are each spring loaded by means of a piston/cylinder arrangement, similar to the arrangement 17 in FIG. 1, independently of one another for the purpose of tensioning the wire looping round the drum 6 and the tension roller 10.

As a result of the rotation of the two shafts 29 and 30 in the same direction, the tension roller 10 is displaced in parallel, and as a result of the rotation of the outer shaft 30 alone the tension roller 10 is pivoted about the end located at the top in FIG. 6. As a result of the rotation of the two shafts 29 and 30 through equal angles in the opposite direction, the tension roller is pivoted about its axis centrepoint. Finally, as a result of the rotation of the two shafts 29 and 30 through unequal angles, the tension roller 10 can be displaced parallel to itself and pivoted.

Figure 7:
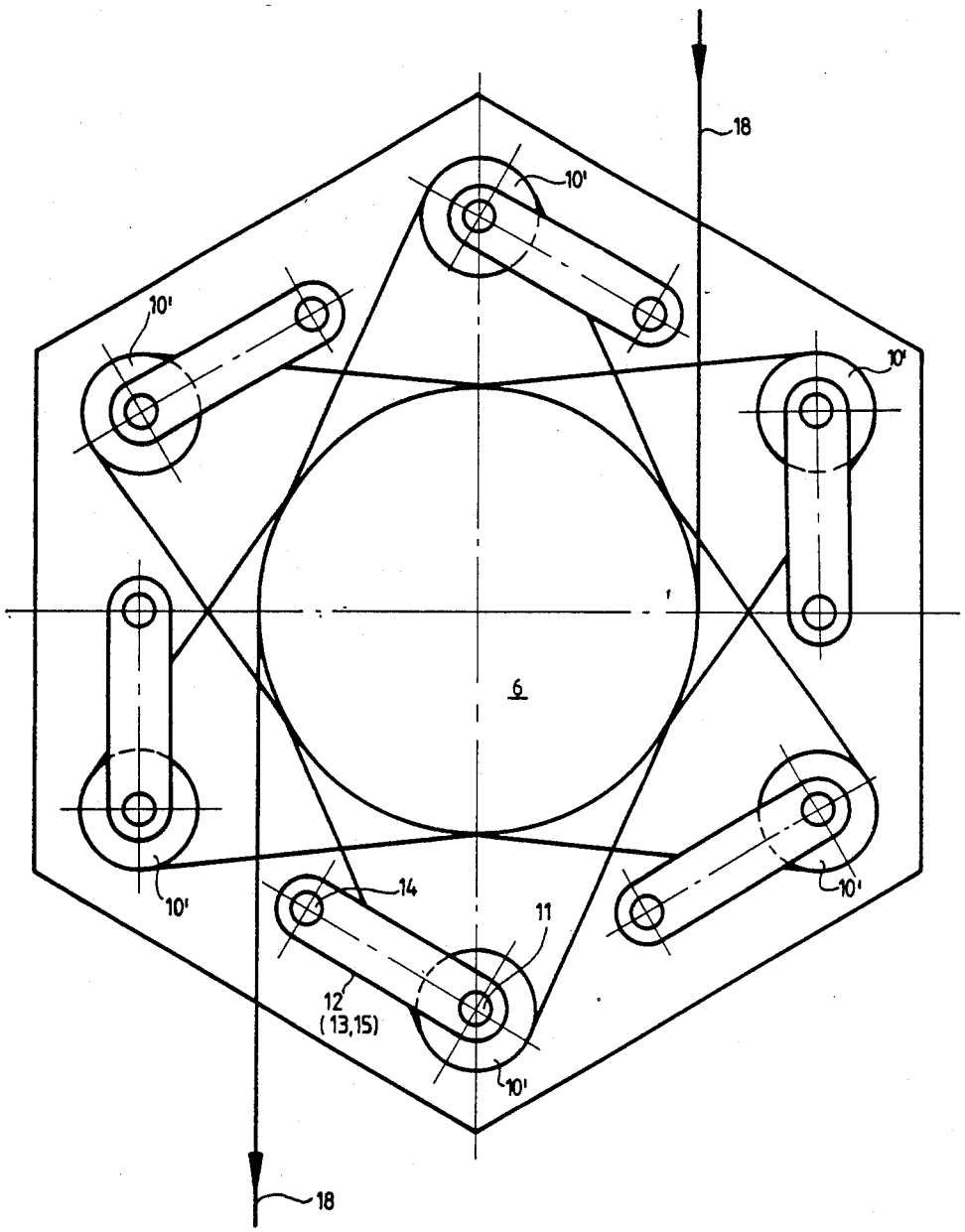
FIG. 7 shows an apparatus according to the invention, in which a group of tension rollers is assigned to the drum; and, FIG. 8 shows an advantageous design of the drum and/or the tension roller.

A further embodiment of the invention is shown in a diagrammatic plan view (with the furnace hood lifted off) in FIG. 7. According to FIG. 7, a group of six tension rollers 10' is arranged in the form of a star round a drum 6. These tension rollers 10' can be mounted displaceably and/or pivotably, as was described with reference to FIGS. 1 to 3 (displaceable mounting), FIGS. 4 and 5 (pivotable mounting) and FIG. 6 (displaceable and pivotable mounting). In FIG. 7, the same reference symbols as in FIGS. 1 to 3 have been used, for the sake of simplicity, to designate the tension-roller arrangement.

The wire can be guided alternately over the drum 6 and one of the tension rollers 10' essentially as desired. The tension rollers 10' can have substantially the same length as the drum 6, thus ensuring a particularly high degree of freedom as regards the guidance of the wire over the drum/tension roller system. However, the tension rollers can also have only a fraction of the length of the drum, in the example illustrated approximately one sixth of this length, each tension roller being arranged opposite a specific length portion of the drum axle, and the wire being guided in several turns over the drum and the first tension roller, then over the drum and the second tension roller, etc..

To ensure perfect guidance of the wire 18 round the drum 6 and round the tension rollers 10', their surfaces can have grooves 25 extending helically, as shown in FIG. 8.

For special heat-treatment purposes, it is possible to provide two similar apparatuses which are filled with inert gas and which are combined into a single unit by means of a pipeline connecting them in an air-tight manner, only the first apparatus being heated, whereas the second has inert gas at room temperature circulated through it. At the same time, as described with reference to FIGS. 4 and 5, the tension rollers 10, 10' are appropriately mounted in an articulated manner at the wire feed end in the first apparatus and at the wire run-off end in the second apparatus.

The apparatus according to the invention is suitable for the heat treatment of wires of virtually any cross-sectional shape and, in particular, also wires of differing metal compositions and correspondingly different treatment temperatures required, especially since the tension rollers adjust automatically as a function of the temperature dependent change in length of the wire.

FIG. 1 illustrates a sensor 34 for measuring the temperature or the tension in wire 18, and a control mechanism 35 responsive thereto for controlling cylinder/piston arrangement 17, whereby the position of tension roller 10 is adjusted automatically according to the expansion or contraction of wire 18 during annealing or cooling.

We claim:

1. Apparatus for the heat treatment of a continuously advanced metal wire, comprising:

a housing, a driven drum, around which a plurality of turns of said wire are looped, said drum having an axle;

at least one tension roller around which a plurality of turns of said wire are looped in series with said turns about said drum, said at least one roller having an axle;

said drum and said tension roller being disposed within said housing, means responsive to the temperature in said housing, for changing the position of said axle of said tension roller relative to said axle of said drum from a predetermined position of rest when the temperature in said apparatus changes, and for applying tension to the turns of the wire which loop in series around said drum and said tension roller with a limited tension force.

2. Apparatus according to claim 1, wherein said axle of said at least one tension roller is guided so as to be displaceable parallel to said axle of said drum.

3. Apparatus according to claim 1, said apparatus having a wire feed end, and wherein said axle of said at least one tension roller is pivotably mounted near said wire feed end.

4. Apparatus according to claim 1, said apparatus having a wire run-off end, and wherein said axle of said at least one tension roller is pivotably mounted near said wire run-off end.

5. Apparatus according to claim 1, including means for guiding said axle of said at least one tension roller so as to be displaceable in parallel to a limited extent from its position of rest, said roller being mounted pivotably between its ends.

6. Apparatus according to claim 1, further comprising a plurality of tension rollers, said rollers being arranged in different radial directions relative to the axle of said drum.

7. Apparatus according to claim 6, wherein said tension rollers are arranged in the form of a star round said drum axle.

8. Apparatus according to claim 1, wherein said at least one tension roller has a smaller diameter than said drum.

9. Apparatus according to claim 1, further comprising spring means for varying the position of said axle of the at least one tension roller according to the change in length of said wire turns, during the heat treatment.

10. Apparatus according to claim 9, wherein said spring means comprises a pneumatic piston/cylinder assembly.

11. Apparatus according to claim 1, wherein said drum and said at least one roller include helically extending peripheral guide grooves for said wire.

12. Apparatus according to claim 1, further comprising a furnace housing, said drum and said at least one tension roller being disposed in said housing.

13. Apparatus according to claim 12, wherein said furnace housing has a hood, said hood being arranged to open automatically in the event of an interruption in the operation of said apparatus.

14. Apparatus according to claim 13, further including a heating means, and wherein said heating means is arranged within said hood.

15. Apparatus for the annealing and subsequent cooling of a continuously moved wire, said apparatus comprising a first apparatus annealing a continuously advanced metal wire, said first apparatus having a wire-feed end and comprising:

a first housing, a first driven drum, around which a plurality of turns of said wire are looped, said first drum having an axle;

at least one first tension roller around which a plurality of turns of said wire are looped in series with said turns about said first driven drum, said at least one first roller having an axle and said axle being mounted pivotably near said wire feed end;

said first driven drum and said first tension roller being disposed within said first housing, first means responsive to the temperature in said first housing for changing the position of said axle of said first tension roller relative to said axle of said first drum from a predetermined position of rest when said temperature in said first apparatus changes thereby to tension the turns of the wire which loop in series around said first drum and said first tension roller with a limited tension force;

and a second apparatus for subsequently cooling said wire, said second apparatus having a wire run-off end and comprising:

a second housing, a second driven drum, around which a plurality of turns of said wire are looped, said second drum having an axle;

at least one second tension roller around which a plurality of turns of said wire are looped in series with said turns about said second driven drum, said at least one second roller having an axle, said axle being mounted pivotably near said wire run-off end;

said second driven drum and said second tension roller being disposed within said second housing, second means responsive to the temperature in said second housing for changing the position of said axle of said second tension roller relative to said axle of said second drum from a predetermined position of rest when said temperature in said second apparatus changes thereby to tension the turns of the wire which loop in series around said second drum and said second tension roller with a limited tension force.

* * * * *